US006834446B2

(12) United States Patent
McMullin

(10) Patent No.: US 6,834,446 B2
(45) Date of Patent: Dec. 28, 2004

(54) INDEXABLE SHOE CLEAT WITH IMPROVED TRACTION

(75) Inventor: Faris W. McMullin, Boise, ID (US)

(73) Assignee: Softspikes, LLC, Gaithersburg, MD (US)

( * ) Notice: Subject to any disclaimer, the term of this patent is extended or adjusted under 35 U.S.C. 154(b) by 0 days.

(21) Appl. No.: 10/228,360

(22) Filed: Aug. 27, 2002

(65) Prior Publication Data

US 2004/0040182 A1 Mar. 4, 2004

(51) Int. Cl.[7] ..... A43C 15/16
(52) U.S. Cl. ..... 36/134; 36/127
(58) Field of Search ..... 36/134, 67 R, 36/67 A, 67 B, 67 D, 59 A, 127; D2/962

(56) References Cited

U.S. PATENT DOCUMENTS

| | | | |
|---|---|---|---|
| 39,575 | A | 8/1863 | Hyatt et al. |
| 180,578 | A | 8/1876 | Gansalus |
| 416,861 | A | 12/1889 | Scafe |
| 485,459 | A | 11/1892 | Crocker |
| 697,135 | A | 4/1902 | Dearing |
| 962,719 | A | 6/1910 | Pratt |
| 982,278 | A | 1/1911 | Kline |
| 1,093,358 | A | 4/1914 | Schroeder |
| 1,243,209 | A | 10/1917 | Park |
| 1,304,616 | A | 5/1919 | Smith |
| 1,355,827 | A | 10/1920 | Finneran |
| 1,422,716 | A | 7/1922 | Jones |
| 1,749,351 | A | 3/1930 | McQueen |
| 1,768,426 | A | 6/1930 | Stelzer |
| 1,827,514 | A | 10/1931 | Golden |
| 1,876,195 | A | 9/1932 | Youmans |
| 2,185,397 | A | 1/1940 | Birchfield |
| 2,213,289 | A | 9/1940 | Riddell |
| 2,223,794 | A | 12/1940 | Pierce et al. |

(List continued on next page.)

FOREIGN PATENT DOCUMENTS

| | | |
|---|---|---|
| AT | 109770 | 5/1928 |
| CA | 2231216 | 9/1998 |
| CH | 670 800 | 7/1989 |
| DE | 185659 | 6/1907 |
| DE | 156642 | 7/1939 |
| DE | 2529027 | 1/1977 |

(List continued on next page.)

OTHER PUBLICATIONS

Softspikes, Inc., Advertisemement, *Golf Digest*, Dec. 1996, p. 149.

*Primary Examiner*—Ted Kavanaugh
(74) *Attorney, Agent, or Firm*—Edell, Shapiro & Finnan, LLC

(57) ABSTRACT

A shoe cleat with improved traction includes at least one dynamic traction element and at least one static traction element extending from a hub, where the traction elements are asymmetrically positioned about a central axis of the hub. The dynamic traction element is configured to deflect toward the shoe sole when the shoe to which the cleat is secured engages a ground surface, whereas the static traction element is configured to substantially resist flexing when the shoe engages the ground surface. The asymmetrical arrangement of traction elements on the hub facilitates the indexing of the shoe cleat with respect to the shoe sole to provide a variety of forms of enhanced traction for the shoe for different applications.

12 Claims, 4 Drawing Sheets

U.S. PATENT DOCUMENTS

| | | | |
|---|---|---|---|
| 2,258,805 | A | 10/1941 | Phillips |
| 2,276,887 | A | 3/1942 | Smith |
| 2,292,299 | A | 8/1942 | Smith |
| 2,336,632 | A | 12/1943 | Park |
| 2,423,753 | A | 7/1947 | Brooks |
| 2,491,596 | A | 12/1949 | Zaleski et al. |
| 2,740,208 | A | 4/1956 | Dye |
| 2,745,197 | A | 5/1956 | Holt |
| 2,758,396 | A | 8/1956 | Edwards |
| 2,758,151 | A | 12/1956 | Dahlquist et al. |
| 2,784,503 | A | 3/1957 | Anderson |
| 2,803,070 | A | 8/1957 | Passidomo et al. |
| 2,844,833 | A | 7/1958 | Odermatt |
| 2,895,235 | A | 7/1959 | Melchiona |
| 3,328,901 | A | 7/1967 | Strickland |
| 3,487,563 | A | 1/1970 | Austin |
| 3,512,275 | A | 5/1970 | Leavitt |
| 3,559,310 | A | 2/1971 | Kiela |
| 3,561,140 | A | 2/1971 | Ludwig |
| 3,583,082 | A | 6/1971 | Jordan, Jr. |
| 3,583,083 | A | 6/1971 | Drew |
| 3,656,245 | A | 4/1972 | Wilson |
| 3,672,077 | A | 6/1972 | Coles |
| 3,747,238 | A | 7/1973 | Jankauskas |
| 3,766,670 | A | 10/1973 | Nakajima |
| 3,775,874 | A | 12/1973 | Bonneville |
| 3,818,617 | A | 6/1974 | Dassler et al. |
| 3,859,739 | A | 1/1975 | Dassler |
| 3,890,725 | A | 6/1975 | Lea et al. |
| 4,014,114 | A | 3/1977 | Jordan et al. |
| 4,118,878 | A | 10/1978 | Semon |
| 4,141,158 | A | 2/1979 | Benseler et al. |
| 4,180,923 | A | 1/1980 | Dassler |
| 4,205,466 | A | 6/1980 | Collins |
| 4,233,759 | A | 11/1980 | Bente et al. |
| 4,299,038 | A | 11/1981 | Epple |
| 4,309,376 | A | 1/1982 | Ueno et al. |
| 4,330,950 | A | 5/1982 | Reddien |
| 4,360,490 | A | 11/1982 | Collins |
| 4,366,632 | A | 1/1983 | Bente |
| 4,375,728 | A | 3/1983 | Dassler |
| 4,392,312 | A | 7/1983 | Crowley et al. |
| 4,492,047 | A | 1/1985 | Arff |
| 4,521,979 | A | 6/1985 | Blaser |
| 4,527,345 | A | 7/1985 | Lopez |
| 4,571,852 | A | 2/1986 | Lamarche et al. |
| 4,587,748 | A | 5/1986 | Collins |
| 4,633,600 | A | 1/1987 | Dassler et al. |
| D288,262 | S | 2/1987 | Yokoishi |
| 4,648,187 | A | 3/1987 | Dassler |
| 4,689,901 | A | 9/1987 | Ihlenburg |
| 4,723,366 | A | 2/1988 | Hagger |
| 4,727,661 | A | 3/1988 | Kuhn |
| 4,777,738 | A | 10/1988 | Giese et al. |
| 4,782,604 | A | 11/1988 | Wen-Shown |
| 4,833,796 | A | 5/1989 | Flemming |
| 4,837,949 | A | 6/1989 | Dufour |
| 4,885,851 | A | 12/1989 | Peterson |
| 5,029,405 | A | 7/1991 | DeHaitre |
| 5,033,211 | A | 7/1991 | Latraverse et al. |
| D320,882 | S | 10/1991 | Collins |
| 5,065,534 | A | 11/1991 | Collins |
| 5,070,631 | A | 12/1991 | Fenton |
| 5,077,916 | A | 1/1992 | Beneteau |
| D327,975 | S | 7/1992 | Saito et al. |
| D341,479 | S | 11/1993 | Saito et al. |
| D341,480 | S | 11/1993 | Saito et al. |
| D341,704 | S | 11/1993 | Saito et al. |
| D341,705 | S | 11/1993 | Saito et al. |
| 5,259,129 | A | 11/1993 | Deacon et al. |
| D341,938 | S | 12/1993 | Saito et al. |
| D342,151 | S | 12/1993 | Saito et al. |
| D342,152 | S | 12/1993 | Saito et al. |
| D342,373 | S | 12/1993 | Saito et al. |
| 5,321,901 | A | 6/1994 | Kelly |
| 5,367,793 | A | 11/1994 | Deacon et al. |
| 5,410,823 | A | 5/1995 | Iyoob |
| 5,426,873 | A | 6/1995 | Savoie |
| 5,452,526 | A | 9/1995 | Collins |
| 5,483,760 | A | 1/1996 | Kataoka et al. |
| 5,524,367 | A | 6/1996 | Ferreira et al. |
| 5,533,282 | A | 7/1996 | Kataoka et al. |
| 5,572,807 | A | 11/1996 | Ketty et al. |
| 5,623,774 | A | 4/1997 | Abbey |
| D385,988 | S | 11/1997 | McMullin |
| D387,548 | S | 12/1997 | McMullin |
| D389,299 | S | 1/1998 | McMullin |
| 5,791,071 | A | 8/1998 | Rosdail |
| 5,794,367 | A | 8/1998 | Carroll |
| D401,046 | S | 11/1998 | McMullin |
| D404,192 | S | 1/1999 | McMullin |
| 5,860,228 | A | 1/1999 | Bathum |
| 5,887,371 | A | 3/1999 | Curley, Jr. |
| D407,893 | S | 4/1999 | McMullin |
| D408,122 | S | 4/1999 | McMullin |
| 5,901,472 | A | 5/1999 | Adam |
| D415,340 | S | 10/1999 | McMullin |
| 5,974,700 | A | 11/1999 | Kelly |
| 5,996,260 | A | 12/1999 | MacNeill |
| 6,023,860 | A | 2/2000 | McMullin |
| 6,041,526 | A | 3/2000 | Collins |
| 6,052,923 | A | 4/2000 | McMullin |
| 6,094,843 | A | 8/2000 | Curley, Jr. |
| D432,770 | S | 10/2000 | Breault |
| 6,167,641 | B1 | 1/2001 | McMullin |
| D439,396 | S | 3/2001 | Savoie |
| D439,733 | S | 4/2001 | Savoie |
| 6,248,278 | B1 | 6/2001 | Kelly |
| D463,902 | S * | 10/2002 | Yang ..... D2/962 |
| D473,699 | S * | 4/2003 | Savoie ..... D2/962 |
| 6,675,505 | B2 * | 1/2004 | Terashima ..... 36/134 |
| 2003/0131502 | A1 * | 7/2003 | Terashima ..... 36/127 |
| 2003/0172556 | A1 * | 9/2003 | Terashima ..... 36/134 |
| 2003/0188458 | A1 * | 10/2003 | Kelly ..... 36/128 |

FOREIGN PATENT DOCUMENTS

| | | |
|---|---|---|
| DE | 2540426 | 3/1977 |
| DE | 3438060 | 6/1985 |
| DE | 4316650 | 11/1993 |
| EP | 0 153 136 | 8/1985 |
| EP | 0 282 257 | 9/1988 |
| EP | 0 342 232 | 11/1989 |
| EP | 0363217 | 4/1990 |
| EP | 0 524 861 | 1/1993 |
| FR | 493748 | 8/1919 |
| FR | 807754 | 1/1937 |
| FR | 536202 | 4/1992 |
| GB | 6877 | 2/1896 |
| GB | 2814 | 2/1914 |
| GB | 2266223 | 10/1933 |
| GB | 401979 | 11/1933 |
| GB | 1139239 | 1/1969 |
| GB | 1 263 960 | 2/1972 |
| GB | 1378461 | 12/1974 |
| GB | 1434282 | 5/1976 |
| GB | 2004731 | 4/1979 |
| GB | 1 564 903 | 4/1980 |
| GB | 2 053 658 | 2/1981 |
| GB | 1587382 | 4/1981 |
| GB | 2 160 146 | 12/1985 |
| GB | 2 163 037 | 2/1986 |

| | | | | | |
|---|---|---|---|---|---|
| GB | 2 191 079 | 12/1987 | JP | 3027022 | 5/1996 |
| GB | 2223394 | 4/1990 | JP | 9-168405 | 6/1997 |
| GB | 2248762 | 4/1992 | WO | 91/03960 | 4/1991 |
| GB | 2 298 563 | 9/1996 | WO | 94/28750 | 12/1994 |
| GB | 2322787 | 9/1998 | WO | 97/18724 | 5/1997 |
| IT | 467815 | 12/1951 | WO | 98/35575 | 8/1998 |
| JP | 57-30003 | 7/1980 | WO | 01/54528 | * 8/2001 |
| JP | 51-2928 | 5/1989 | | | |
| JP | 7-209 | 1/1995 | | | |

* cited by examiner

INDEXABLE SHOE CLEAT WITH IMPROVED TRACTION

BACKGROUND OF THE INVENTION

1. Technical Field

The present invention pertains to cleats for use with shoes worn on turf and other surfaces. In particular, the present invention pertains to a golf cleat that provides traction on various types of surfaces and for specific purposes.

2. Discussion of Related Art

The need for providing improved traction elements for the soles of shoes on turf surfaces is well known in the art, particularly in the field of sports such as football, baseball, soccer and golf. In many sports, particularly golf, the need for providing improved traction elements must be considered in combination with limiting the wear and tear on the playing turf that can be caused by the traction elements.

In recent years, there has been a change from using penetrating metal spikes for golf shoes to removable plastic cleats that are much more turf-friendly and less harmful to clubhouse floor surfaces. However, the challenge with utilizing plastic cleats is to design a cleat having suitable traction on turf surfaces while being suitably protected from wear and tear due to contact with hard surfaces such as asphalt or concrete.

An example of a removable plastic cleat having desirable traction characteristics is described and illustrated in U.S. Pat. No. 6,167,641 (McMullin), the disclosure of which is incorporated herein by reference in its entirety. In the McMullin patent there is disclosed a removable cleat having a hub with an upper surface facing the shoe sole and a bottom surface facing away from the sole. A hub attachment member extends from the upper surface for attaching the hub to one of plural sole-mounted attachment means. Traction elements extend outwardly and downwardly from the hub, each traction element being deflectably attached to the hub so that it pivotally and resiliently deflects toward the sole when it encounters a hard surface. When used on grass or turf, the traction element deflection results in grass blades being trapped between the upper surface of the traction elements and the sole of the shoe, thereby grabbing the grass blades and providing the desired traction function. In addition, the deflection serves to minimize abrasive wear of the traction elements on hard surfaces such as golf paths. Importantly, the traction elements do not penetrate the surface on which they are used, thereby minimizing damage to the turf. Although this cleat is effective for the purpose described, improvements are desirable in certain aspects of the cleat performance. For example, on hard surfaces such as found in a tee box, dirt path, concrete, asphalt, tile, etc., the deflecting traction elements provide only minimal, if any, traction since each traction element is designed to spread and flex on the ground surface.

Another removable plastic cleat for golf shoes is disclosed in WO 01/54528 to Japana Co., LTD. The Japana golf shoe cleat includes a plurality of long and short legs protruding outwardly from a body of the cleat to contact a turf surface when connected to the sole of a shoe. The long legs and short legs are disposed along a periphery of the cleat body in an alternating configuration, where one or more long legs are provided between two adjacent short legs. The long legs are provided to provide traction on turf whereas the short legs press down hard on the grass and chiefly support the weight bearing on the cleat. The Japana cleat is limited in that it only discloses symmetrically alternating long and short legs extending from the shoe sole. Thus, the axially symmetric Japana cleat is not capable of being indexed or oriented in different positions with respect to the shoe sole in order to selectively position the weight bearing shorter legs and the penetrating longer legs in different alignments based upon cleat applications requiring different directions and levels of traction.

It is therefore desirable to provide a cleat that minimizes damage to turf surfaces yet provides suitable traction for the shoe on harder surfaces as well as different levels of traction at different portions of the shoe based upon selected orientations of the shoe cleat with respect to the shoe sole.

OBJECTS AND SUMMARY OF THE INVENTION

Therefore, in light of the above, and for other reasons that become apparent when the invention is fully described, an object of the present invention is to provide a shoe cleat with enhanced traction while minimizing damage to turf surfaces.

It is another object of the present invention to provide a shoe cleat that does not easily wear on hard surfaces such as concrete or asphalt yet provides a suitable level of traction for such hard surfaces.

It is a further object of the present invention to provide a shoe cleat that is indexable to facilitate a variety of orientations of the cleat with respect to the shoe sole.

The aforesaid objects are achieved individually and in combination, and it is not intended that the present invention be construed as requiring two or more of the objects to be combined unless expressly required by the claims attached hereto.

In accordance with the present invention, an indexable shoe cleat is provided including a hub with at least one dynamic traction element and at least one static traction element extending from an exposed surface of the hub and away from the sole of a shoe when the cleat is secured to the shoe sole, where the traction elements are asymmetrically positioned about a central axis of the hub. The dynamic traction element is configured to deflect toward the shoe sole when the shoe engages a ground surface to reduce damage to turf surfaces as well as to minimize wear and tear to the cleat on harder surfaces. The static traction element is configured to substantially resist deflection when the shoe engages the ground surface and to provide a suitable bearing for supporting weight applied to the shoe. A cleat connector is preferably disposed on a surface of the hub that opposes the exposed surface to connect the cleat to the shoe sole. The cleat connector is suitably configured to connect the cleat to the shoe sole so as to align each of the static and dynamic traction elements in a desired orientation with respect to the shoe. A plurality of shoe cleats may further be selectively indexed on the shoe to vary the orientations of the traction elements of each cleat with respect to the shoe sole based upon a particular application and/or user preference.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION OF PREFERRED EMBODIMENTS

Figure 1:
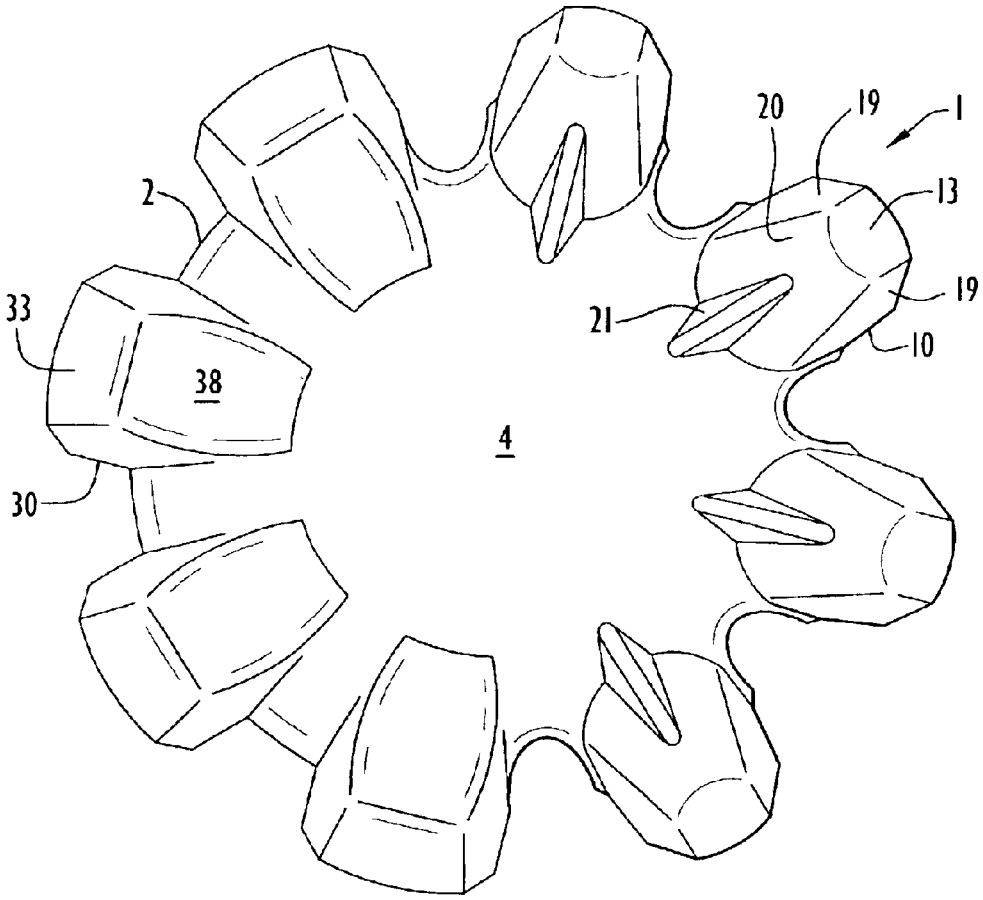
FIG. 1 is a bottom view in plan of an exemplary shoe cleat in accordance with the present invention.
Figure 2:
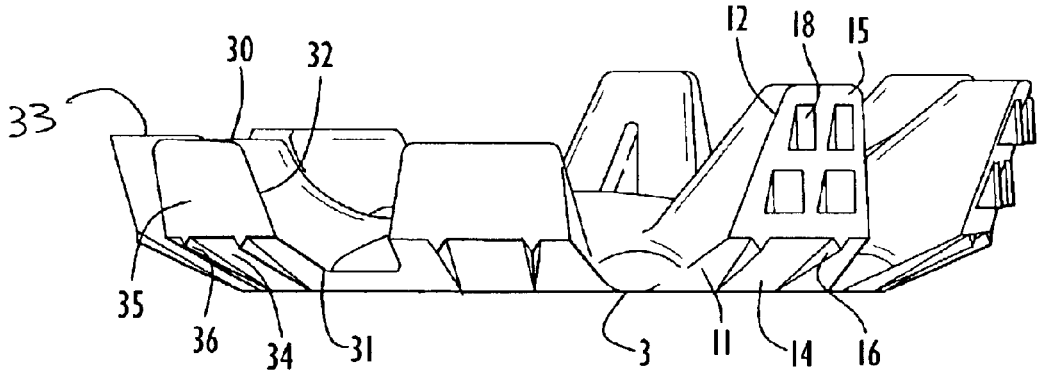
FIG. 2 is a side view in elevation of the shoe cleat of FIG. 1.

The present invention includes a cleat that is secured to a shoe sole to enhance traction of the shoe. Referring to FIGS. 1 and 2, shoe cleat 1 includes a generally circular hub 2 having a top surface 3 and a bottom surface 4. However, the hub is not limited to a circular configuration but may have any suitable geometric configuration including, without limitation, rounded, elliptical, rectangular, triangular, etc. It is to be understood that the terms "top surface" and "bottom surface" as used herein refer to surfaces of the shoe cleat that face toward or away, respectively, from the shoe sole. The top surface of the hub may be connected to the shoe sole in any suitable manner to secure the cleat to the shoe. Preferably, the shoe cleat is removably connected to the shoe sole with a cleat connector such as the connector illustrated in FIG. 5 and described below. The cleat is preferably constructed of any suitable plastic materials, including, without limitation, polycarbonates, polyamides (e.g., nylon), polyurethanes, natural or synthetic rubbers (e.g., styrene-butadiene), and other elastomeric polyolefins.

Extending from the bottom surface periphery of the hub in a cantilevered manner is a plurality of traction elements. The traction elements engage the ground surface when the shoe to which the cleat is attached is brought down into contact with that surface. The traction elements include a set of four sequentially aligned and substantially evenly spaced dynamic traction elements 10 and a set of four sequentially aligned and substantially evenly spaced static traction elements 30. However, it is noted that any suitable spacing distance (e.g., even or uneven) between traction elements may be utilized. The dynamic traction elements are designed to resiliently pivot with respect to the hub and deflect toward the shoe sole when the shoe engages a ground surface as described below, whereas the static traction elements remain substantially rigid and are resistant to deflection upon engaging the ground surface.

Figure 3:
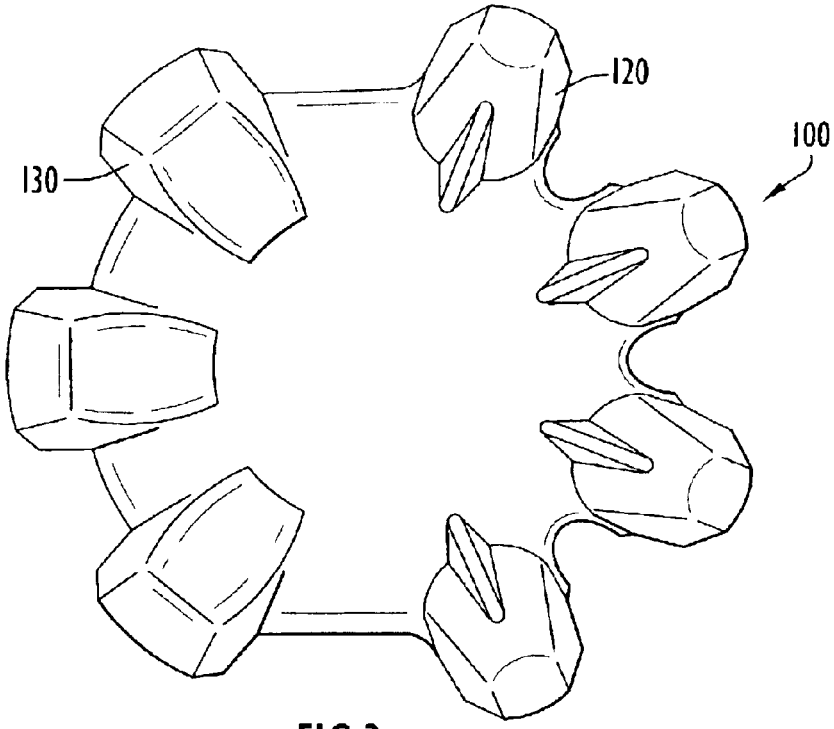
FIG. 3 is a bottom view in plan of an alternative embodiment of an exemplary shoe cleat in accordance with the present invention.
Figure 4:
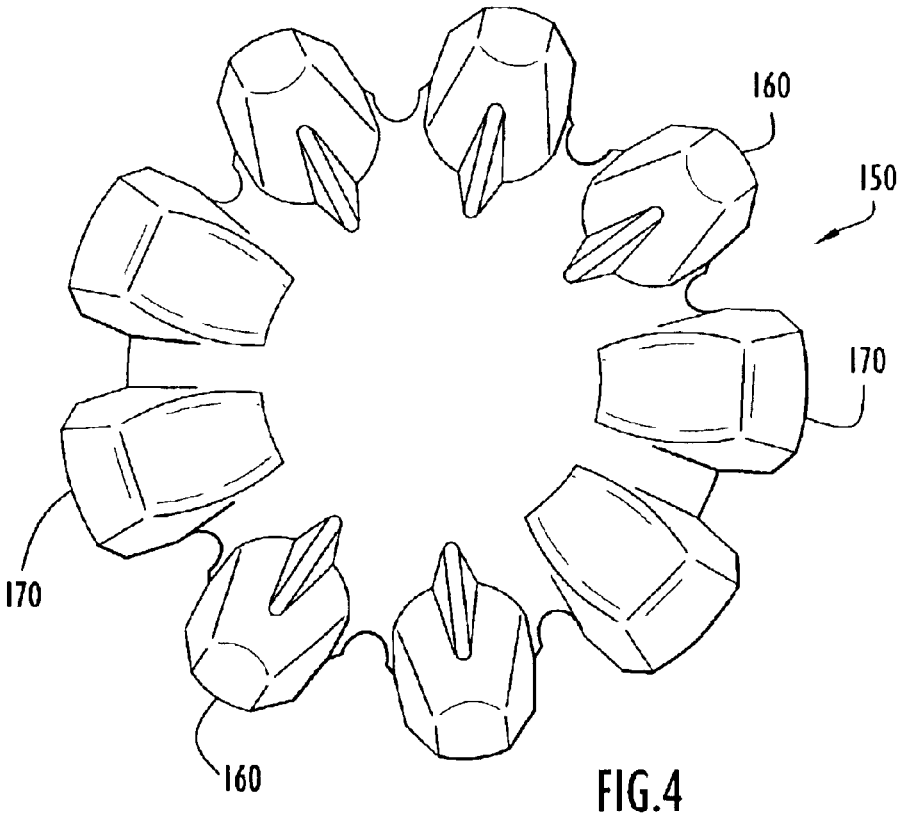
FIG. 4 is a bottom view in plan of another alternative embodiment of an exemplary shoe cleat in accordance with the present invention.

The dynamic traction elements 10 are generally aligned in a set along a first half of the hub perimeter, whereas the static traction elements 30 are generally aligned in a set along the remaining half of the hub perimeter. However, it is noted that any suitable number of sets of traction elements including any suitable number of static or dynamic traction elements may be oriented in axial asymmetry in any suitable manner along the hub bottom surface. For example, in an alternative embodiment depicted in FIG. 3, cleat 100 includes a set of four dynamic traction elements 120 and a set of three static traction elements 130. Other embodiments may include sets having a greater number of static traction elements than sets with dynamic traction elements as well as multiple sets of one or both of the static and dynamic traction elements. Another exemplary embodiment of a shoe cleat with multiple sets of traction elements is depicted in FIG. 4, where cleat 150 includes two sets of dynamic traction elements 160 and two sets of static traction elements 170. Specifically, cleat 150 includes a set of three dynamic traction elements, a set of two dynamic traction elements, and two sets of two static traction elements. The selection of a specific cleat design, including a selected number of each type of traction element as well as a selected orientation of the traction elements in sets on the hub, may depend upon a specific application in which the cleat will be utilized and the type or amount of traction that is desired for that application.

Each dynamic traction element 10 includes a generally rectangular upper leg 11 extending at an obtuse angle (e.g., approximately 155°) from a peripheral side portion of hub 4 and a generally polyhedral lower leg 12 that extends at an obtuse angle (e.g., approximately 135°) from the upper leg and tapers toward its terminal end, where the lower leg is greater in longitudinal dimension than the upper leg. Each lower leg 12 terminates at a foot 13 that has a rounded, convex curvature with respect to the ground surface when the cleat is attached to a shoe. The dynamic traction elements 10 have substantially similar dimensions, with their feet 13 all residing in and defining a plane that is generally parallel to the bottom surface of the hub. The dimensional design and/or materials of construction of dynamic traction elements 10 are selected to permit a selected degree of deflection of the dynamic traction elements when the cleat is forced against the ground surface as described below. Preferably, the radial dimension of the hub is reduced to form a concave hub perimeter on either side of each dynamic traction element so as to enhance deflection of these elements when the cleat engages a ground surface.

Each upper leg 11 is partially defined by a generally rectangular outer surface 14 extending from the periphery of the top surface of the hub to a generally trapezoidal outer surface 15 defining a portion of each corresponding lower leg 12. It is to be understood that the terms "inner surface" and "outer surface" as used herein refer to surfaces of the static and dynamic traction elements that face toward or away, respectively, from the central axis of the hub (i.e., the axis extending between the top and bottom surfaces of the hub through its center). Opposing trapezoidal side surfaces 19 of each lower leg 12 are disposed between the inner and outer surfaces of the lower leg and extend from corresponding side surfaces of upper leg 11 to foot 13. The outer surface 14 of the upper leg includes a pair of longitudinally extending triangular ridges 16, where each ridge 16 extends from the junction of the upper leg outer surface with the hub top surface to the junction of the upper leg outer surface with the lower leg outer surface 15. Similarly, lower leg outer surfaces 15 include a number of outwardly extending ramped sections 18 that extend in a direction toward the upper legs. The ridges and ramped sections of the upper and lower leg outer surfaces provide enhanced traction for the dynamic traction elements as described below. Alternatively, it is noted that any number of suitable protrusions may be provided on the outer surfaces of the dynamic traction elements to enhance traction as described below.

Each lower leg 12 of the dynamic traction elements is further partially defined by an inner surface 20 extending from the hub bottom surface to foot 13 at the free end of the lower leg. Each inner surface 20 has a generally trapezoidal geometry with a slight convex curvature. Preferably, but not necessarily, gussets 21 are provided along the interior surfaces of the lower legs to assist in biasing the deflected dynamic traction elements back to their original positions when the shoe to which the cleat is attached is lifted from the ground surface. Each gusset 21 is generally triangular, with one side of the gusset attaching to a portion of the lower leg inner surface of a corresponding dynamic traction element and another side of the gusset attaching to a portion of the hub bottom surface. The gussets are preferably resilient to act as springs, pulling the dynamic traction elements back into their upright, cantilevered positions when the shoe is raised from a ground surface. In addition, each gusset preferably acts as a wear surface when the dynamic traction elements are deflected toward the shoe sole, so that even the inner surfaces of these traction elements are substantially protected from abrasion.

Static traction elements 30 each include a generally rectangular upper leg 31 extending at an obtuse angle (e.g., about 155°) from a peripheral side portion of hub 4 and a generally rectangular lower leg 32 extending at an obtuse angle (e.g., about 135°) from the upper leg. Each lower leg 32 terminates at a foot 33 that has a rounded, convex curvature with respect to the ground surface when the cleat is attached to a shoe. The static traction elements 30 have substantially similar dimensions, with their feet 33 all residing in and defining a plane that is generally parallel to the bottom surface of the hub. That plane is also parallel to the plane defined by feet 13 but resides closer to hub 4. Accordingly, the static traction elements are all shorter in longitudinal dimension than the dynamic traction elements and thus extend a shorter distance from the bottom surface of hub 4. It is noted that the dimensions and/or materials of construction of static traction elements 30 are selected to prevent or substantially resist deflection of the static traction elements when the cleat engages a ground surface. The radial dimension of the hub remains substantially constant between adjacent static traction elements to further support and prevent or resist deflection of these elements. The feet of the static traction elements are also preferably larger in dimension than the feet of the dynamic traction elements to enhance the weight bearing capabilities of the static traction elements when the shoe is pressed against the ground surface while preventing or minimizing puncturing or indenting of the turf surface.

Each upper leg 31 of the static traction elements is partially defined by a generally rectangular outer surface 34 extending from the periphery of the top surface of the hub to a generally rectangular outer surface 35 defining a portion of each corresponding lower leg 32. The outer surface 34 of the upper leg includes a pair of longitudinally extending triangular ridges 36, where each ridge 36 extends from the junction of the upper leg outer surface with the hub top surface to the junction of the upper leg outer surface with the lower leg outer surface 35. These triangular ridges provide some enhanced traction for the static traction elements as described below, although not to the same extent as the ridges and ramped sections for the dynamic traction elements. Each lower leg 12 of the dynamic traction elements is further partially defined by an inner surface 38 extending from the hub bottom surface to foot 33 at the free end of the lower leg. Each inner surface 38 of the static traction elements has a generally rectangular geometry with a slight concave curvature.

The arrangement of the sets of static and dynamic traction elements on the hub in the manner described above yields a cleat that is asymmetric about the hub central axis, with static traction elements disposed along one half of the hub perimeter and dynamic traction elements disposed along the other half. This axially asymmetric design allows the cleat to be indexed in a desired angular orientation along the surface of the shoe sole to achieve optimum positions for the static and dynamic traction elements and provide for a variety of enhanced traction effects for different applications as described below. The asymmetry may also be described in terms of the sets of dynamic and static traction elements; that is, the dynamic and static sets are positioned asymmetrically with respect to one another, both about the hub axis and about any and all hub diameters. In the embodiment illustrated in FIGS. 1 and 2, the asymmetry is most evident at the feet 13 and 33 since in this embodiment it is the length of the traction elements that determine their dynamic and static function.

Figure 5:
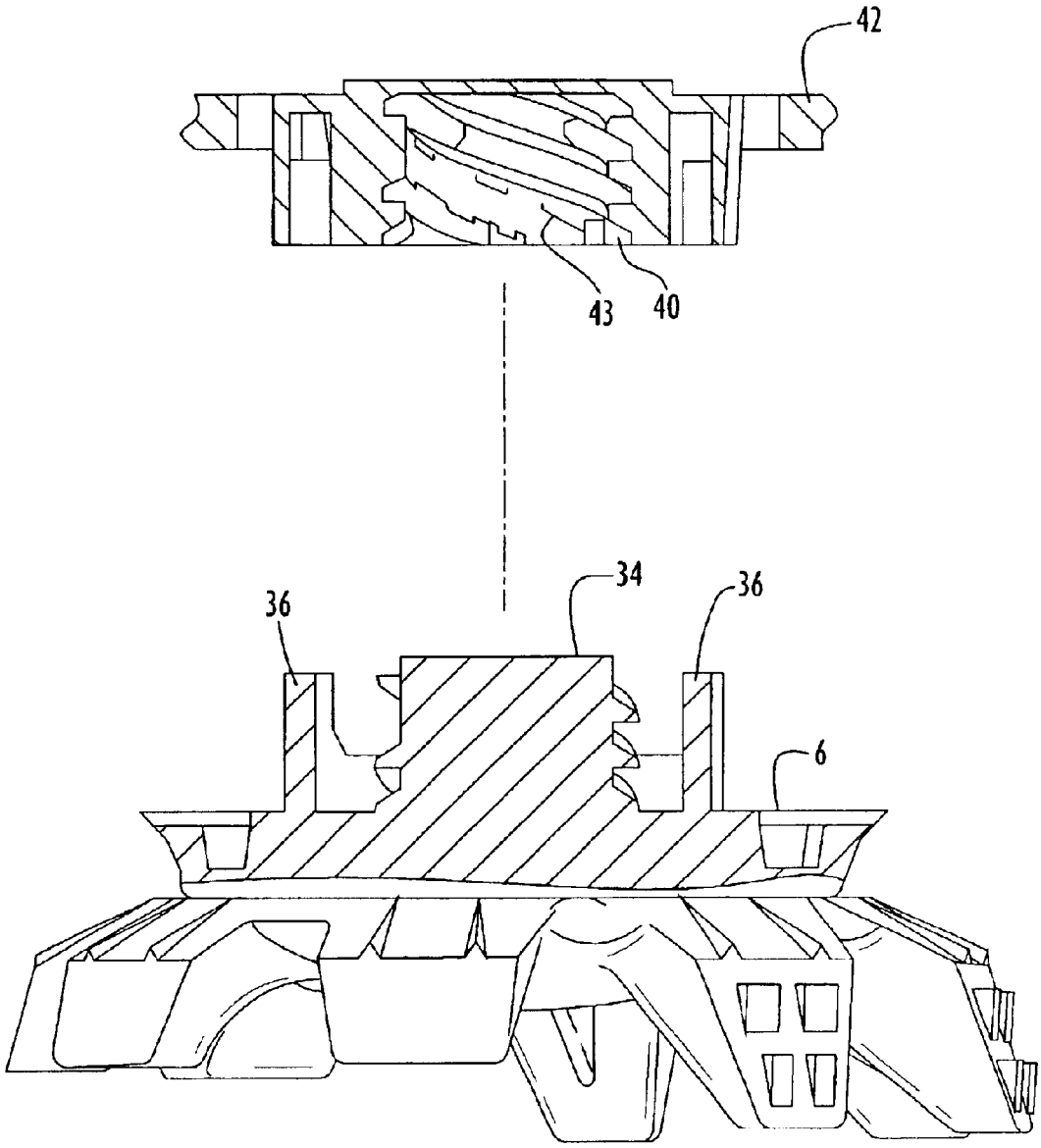
FIG. 5 is an elevated side view in partial section of the shoe cleat of FIG. 1 including a cleat connector and a connection member that engages with the cleat connector.

A precise orientation of the cleat may be facilitated with a cleat connector as illustrated in FIG. 5. Cleat connector 6 extends from the top surface of the hub and is configured to releasably engage with a recess or receptacle 40 in shoe sole 42. The cleat connector is substantially similar in design and function to the cleat connecting member described in U.S. Patent Application Publication No. US2002/0056210 to Kelly et al., the disclosure of which is incorporated herein by reference in its entirety. However, it is noted that any other suitable cleat connector may be utilized to orient the traction elements of the cleat in any desired manner with respect to the shoe cleat in accordance with the present invention. Briefly, cleat connector 6 includes an externally threaded spigot 34 as well as additional projections 36 that align and engage with an internally threaded recess 43 and other corresponding elements disposed within a receptacle 40 of the shoe sole 42 as described in the Kelly et al. published application. As further described in Kelly et al., the cleat connector and receptacle elements appropriately engage with each other by twisting the cleat connector within the receptacle to lock it therein, which in turn aligns the cleat in a specific orientation with respect to the shoe. The cleat connector elements are suitably aligned on the hub and/or the receptacle elements are suitably aligned within the receptacle to achieve a selected orientation of the cleat traction elements with respect to the shoe sole when the cleat connector is locked within the shoe receptacle.

In operation, cleat 1 is connected to the sole of a shoe by engaging cleat connector 6 with receptacle 40 of the shoe sole and twisting the cleat connector in a suitable manner to lock the cleat to the shoe, which in turn orients the static and dynamic traction elements of the cleat in a desired alignment for a particular activity. When the weight of the user is applied to the shoe by pressing the shoe against a ground surface, dynamic traction elements 10 are the first to contact the surface. The dynamic traction elements deflect toward the shoe sole as the shoe is pressed further toward the ground surface, allowing static traction elements 30 to contact the surface when the dynamic traction elements have achieved a certain deflected orientation. Static traction elements 30 substantially maintain their original cantilevered orientation and bear much of the weight applied to the shoe. When the user raises the shoe from the ground surface, the dynamic traction elements resiliently flex back to their original positions, preferably with the help of gussets 21.

The slight convex curvature of feet 13 and 33 of the traction elements spreads the contact over a greater area than a lineal edge and thereby prevents or substantially limit penetration, puncturing or indenting of the traction elements into turf surfaces. This curvature further facilitates the sliding of feet 13 along a surface when the dynamic traction elements are deflected toward the shoe sole. On harder surfaces (e.g., tee boxes or paved surfaces), the static traction elements provide enhanced traction for the cleat by resisting deflection and immediately bearing the weight that is applied to the shoe, while the dynamic traction elements deflect and are protected from serious abrasion by their gussets and the static elements.

The ridges and ramped sections of the dynamic traction elements provide additional traction in turf surfaces by entangling and/or trapping grass blades to limit or prevent slipping of the cleat when engaged with the turf surface. In particular, the dynamic traction elements are preferably designed to allow both the upper and lower legs of each element to deflect against the shoe sole (or any extended portion of the hub) when sufficient weight is applied to the shoe. When pressed against the shoe sole, ramped sections 18 disposed on each lower leg 12 and ridges 16 disposed on each upper leg 11 essentially trap and lock grass blades between outer surfaces 14 and 15 of the upper and lower legs of each dynamic traction element and the shoe sole to resist sliding of the cleat on the turf surface. The static traction elements are structurally unable to deflect toward the shoe sole, and are therefore incapable of trapping grass blades in a manner similar to the dynamic traction elements. However, the ridges of the static traction elements provide an uneven outer surface that can entangle grass blades during contact with the turf, thus providing some enhanced level of traction.

In addition, the shoe sole may contain recesses that correspond and cooperate with the dynamic traction element upper and lower legs and their ridges and ramped sections to provide a greater trapping and locking effect for grass blades by the cleat. Exemplary embodiments of recesses on the shoe sole that cooperate with deflecting dynamic traction elements of a cleat are described in U.S. patent application Ser. No. 10/195,315, the disclosure of which is incorporated herein by reference in its entirety.

The dimensions of the hub and traction elements of the cleat may also be modified to enhance traction and performance of the cleat. For example, it has been determined that cleat traction is most effective when a ratio of a major dimension of the hub (e.g., the diameter for a circular hub) to an overall major dimension of the cleat, as defined by the largest outer boundary between the feet of at least two opposing traction elements, is no greater than about one. Preferably, the ratio of hub major dimension to overall cleat major dimension is no greater than about 0.8. The dimensions of the static traction elements may be shorter than the dynamic traction elements, with static traction elements preferably having longitudinal dimensions in the range of about 4 mm to about 6 mm, and the dynamic traction elements having longitudinal dimensions in the range of about 5.25 mm to about 7.25 mm. However, it is noted that, depending upon a particular application, the cleat may be designed such that dynamic traction elements disposed on the hub have smaller and/or substantially similar longitudinal dimensions as static traction elements on the hub.

Figure 6:
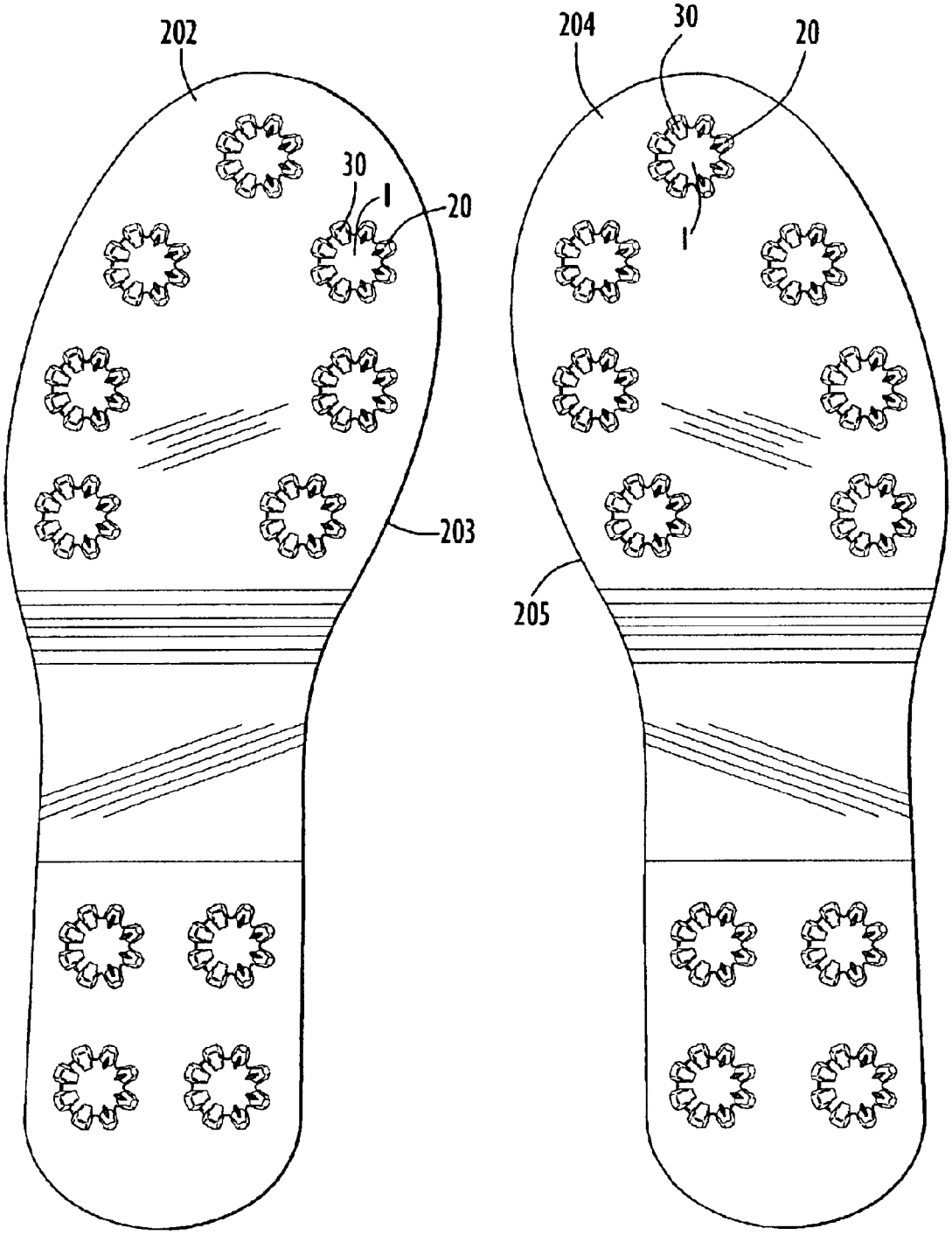
FIG. 6 is a bottom view of a pair of shoes to which are secured a number of shoe cleats substantially similar to the shoe cleat of FIG. 1.

An exemplary orientation or indexing of cleats on a pair of shoes is illustrated in FIG. 6. While each shoe depicted in FIG. 6 includes a total of eleven cleats, the present invention is in no way limited to this cleat orientation or number of cleats per shoe. Rather, any suitable orientations and/or number of cleats may be provided on a shoe to provide enhanced traction for a particular application. Referring to FIG. 6, a right shoe 202 and a left shoe 204 each include cleats 1 that are substantially similar to the cleat described above and illustrated in FIGS. 1 and 2. Each cleat 1 is oriented on right shoe 202 such that its dynamic traction elements 20 generally face or point toward inner sole perimeter 203 of the right shoe, while static traction elements 30 of each cleat generally face or point away from the inner sole perimeter of the right shoe. Conversely, each cleat 1 connected to left shoe 204 is oriented such that its static traction elements 30 generally face or point toward inner sole perimeter 205 of the left shoe and its dynamic traction elements generally face or point away from the left shoe inner sole perimeter. This orientation of the cleats on the right and left shoes is particularly useful for right handed golfers to enhance traction and resist rotation or other sliding movements of the shoes on a turf surface when the right handed golfer swings the club. Conversely, the orientation of the cleats depicted in FIG. 6 may be rotated about 180° to similarly enhance traction and resist rotation or other sliding movements of the shoes on the turf surface for left handed golfers. As described above, the specific orientation of each cleat with respect to the shoe may be controlled by appropriate alignment of the cleat connector elements on the hub and/or corresponding connecting elements in the shoe receptacle.

It will be appreciated that the embodiments described above and illustrated in the drawings represent only a few of the many ways of implementing an indexable cleat with improved traction in accordance with the present invention.

For example, the cleat may include any number of sets of static and dynamic traction elements disposed in any suitable manner along the bottom surface of the cleat hub. Preferably, the static and dynamic traction elements are arranged in an asymmetric manner with respect to the hub central axis so as to facilitate indexing of the cleat orientation with respect to the shoe. The traction elements may have any suitable geometric configuration and may be constructed of any suitable materials that allow the dynamic traction elements to deflect and the static traction elements to substantially resist deflection when engaging a ground surface. Similarly, the hub may be constructed of any suitable materials and have any suitable geometric configuration (e.g., circular, square, elliptical, triangular, etc.). The cleat may include any number of dynamic traction elements having a longitudinal dimension that is greater, smaller or substantially similar to a longitudinal dimension of any number of static traction elements on the cleat. It should also be noted that the static traction elements may be structurally identical throughout their lengths to the corresponding length portions of the dynamic traction elements; that is, the added length of the dynamic elements is what imparts the flexibility to the element and permits it to function as a dynamic traction element. It will be appreciated that flexibility need not be imparted by added length but instead may result for cross-sectional configuration or the material employed.

The cleat may be removably or non-removably secured to the shoe sole. Any suitable cleat connector may be utilized to removably secure the cleat to the shoe in any selected orientation. Any number of cleats may be combined in any number of suitable orientations to provide enhanced traction for a particular user and/or a particular activity.

Having described preferred embodiments of indexable shoe cleats with improved traction, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A cleat securable to a sole of a shoe for providing traction for the shoe on a ground surface, the cleat comprising:

a hub with an exposed surface facing away from the shoe sole when the cleat is secured to the shoe;

at least one dynamic traction element extending from the hub in a direction away from the exposed surface of the hub, the dynamic traction element being configured to deflect toward the shoe sole when the shoe to which the cleat is secured engages the ground surface; and at least one static traction element extending from the hub in a direction away from the exposed surface of the hub, the static traction element being configured to substantially resist flexing when the shoe to which the cleat is secured engages the ground surface;

wherein the traction elements are asymmetrically positioned about a central axis of the hub to facilitate different orientations of the traction elements with respect to the shoe sole when the cleat is secured to the shoe.

2. The cleat of claim 1, wherein the dynamic traction element is greater in longitudinal dimension than the static traction element.

3. The cleat of claim 1, wherein at least one set of adjacently positioned dynamic traction elements extend from the hub and at least one set of adjacently positioned static traction elements extend from the hub.

4. The cleat of claim 1, further comprising a cleat connector extending from a surface of the hub opposing the exposed surface, wherein the cleat connector is configured to releasably secure the cleat to the shoe to align the traction elements in a selected orientation with respect to the shoe sole.

5. The cleat of claim 1, wherein the dynamic traction element includes at least one protrusion extending from an outer surface of the dynamic traction element to engage and trap grass blades between the protrusion and the shoe sole when the shoe to which the cleat is secured engages a turf surface and the dynamic traction element is deflected toward the shoe sole.

6. A shoe for providing traction on a ground surface, the shoe comprising:

a sole; and at least one cleat secured to the shoe sole, the cleat comprising:

a hub with an exposed surface facing away from the shoe sole;

at least one dynamic traction element extending from the shoe sole, the dynamic traction element being configured to deflect toward the shoe sole when the shoe engages the ground surface; and at least one static traction element extending from the hub in a direction away from the shoe sole, the static traction element being configured to substantially resist flexing when the shoe engages the ground surface;

wherein the traction elements are asymmetrically positioned about a central axis of the hub.

7. The shoe of claim 6, wherein the dynamic traction element is greater in longitudinal dimension than the static traction element.

8. The shoe of claim 6, wherein at least one set of adjacently positioned dynamic traction elements extend from the hub and at least one set of adjacently positioned static traction elements extend from the hub.

9. The shoe of claim 6, further comprising:

a receptacle disposed in the shoe sole; and a cleat connector extending from a surface of the hub opposing the exposed surface, wherein the cleat connector releasably engages with the receptacle to connect the cleat to the shoe and align the traction elements in a selected orientation with respect to the shoe sole.

10. The shoe of claim 6, wherein the dynamic traction element includes at least one protrusion extending from an outer surface of the dynamic traction element to engage and trap grass blades between the protrusion and the shoe sole when the shoe engages a turf surface and the dynamic traction element is deflected toward the shoe sole.

11. The shoe of claim 6, wherein a plurality of cleats are secured to the shoe sole in a selected manner to permit different orientations of at least two cleats with respect to the shoe sole.

12. A cleat securable to a sole of a shoe for providing traction for the shoe on a ground surface, the cleat comprising:

a hub with an exposed surface facing away from the shoe sole when the cleat is secured to the shoe;

at least one dynamic traction element extending from the hub in a direction away from the exposed surface of the hub, the dynamic traction element being configured to deflect toward the shoe sole when the shoe to which the cleat is secured engages the ground surface; and at least one static traction element extending from the hub in a direction away from the exposed surface of the hub, the static traction element being configured to substantially resist flexing when the shoe to which the cleat is secured engages the ground surface; wherein the traction elements are asymmetrically positioned about a central axis of the hub to facilitate different orientations of the traction elements with respect to the shoe sole when the cleat is secured to the shoe.

* * * * *